United States Patent [19]

Emery

[11] 4,298,077

[45] Nov. 3, 1981

[54] CIRCULATION VALVE FOR IN-HOLE MOTORS

[75] Inventor: Maurice M. Emery, Costa Mesa, Calif.

[73] Assignee: Smith International, Inc., Newport Beach, Calif.

[21] Appl. No.: 47,296

[22] Filed: Jun. 11, 1979

[51] Int. Cl.[3] ..... E21B 4/02

[52] U.S. Cl. ..... 175/65; 175/107; 175/243; 175/317

[58] Field of Search ..... 175/107, 317, 232, 302, 175/243, 65

[56] References Cited

U.S. PATENT DOCUMENTS

| | | | |
|---|---|---|---|
| 3,005,507 | 10/1961 | Clark, Jr. et al. | 175/324 |
| 3,365,007 | 1/1968 | Skipper | 175/317 |
| 3,833,074 | 9/1974 | Courtois | 175/317 |
| 3,989,114 | 11/1976 | Tschirky et al. | 175/107 |
| 3,997,609 | 12/1976 | Fox | 175/243 |

*Primary Examiner*—William F. Pate, III

*Attorney, Agent, or Firm*—Philip Subkow; Bernard Kriegel; Newton H. Lee, Jr.

[57] ABSTRACT

An in-hole fluid motor has a stator connected with a fluid conduit and a rotor connected with a drive shaft for a bit to drill a bore hole as drilling fluid is circulated through the conduit and the stator, the fluid returning through the bore hole annulus to the top of the bore hole. A circulation valve between the stator and the fluid conduit is opened by the flow of fluid through the valve to by-pass the stator and allow flow of fluid into the annulus. The circulation valve is incorporated in a structure which allows the conduit to fill and dump during lowering in and removal from the fluid in the bore hole.

7 Claims, 7 Drawing Figures

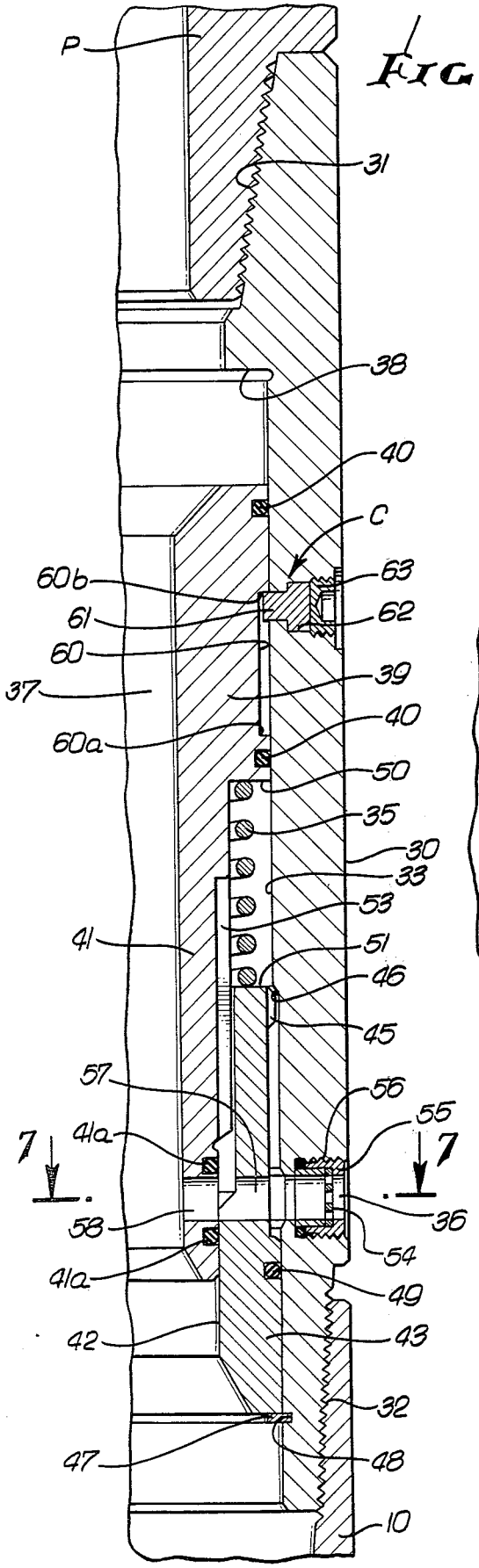
FIG. 4.
FIG. 5.
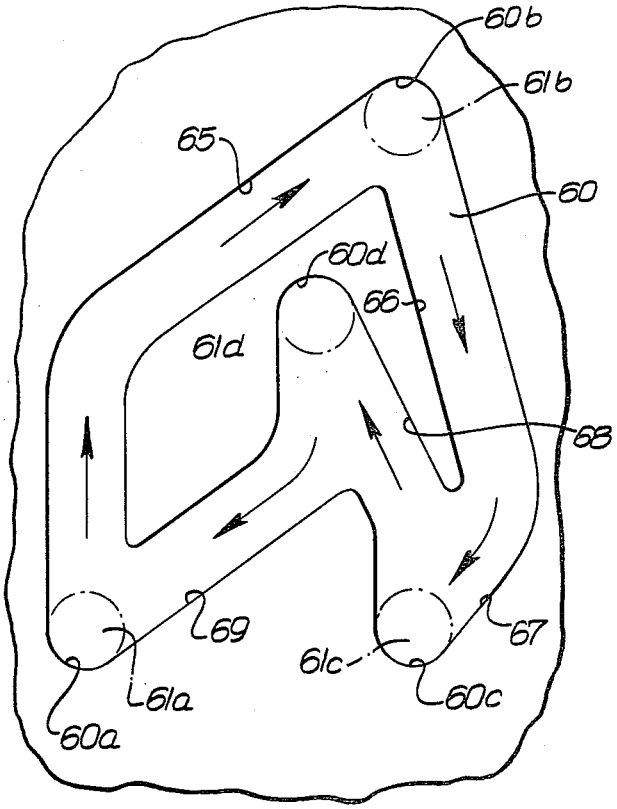

CIRCULATION VALVE FOR IN-HOLE MOTORS

BACKGROUND OF THE INVENTION

In the drilling of bore holes or wells into or through earth formation, it has become a much used practice to drive the drill bit by an in-hole fluid driven motor, such as a turbine or positive displacement or progressive cavity motor having a stator through which fluid flows from a running in string of drill pipe or fluid conduit, driving the motor rotor which is connected with the bit.

It is customary to provide a valve between the motor and the conduit or pipe string which is normally open when the assembly is lowered in the well bore and when the assembly is pulled from the well bore, so that the conduit for pipe string above the motor can fill with fluid or be drained of fluid.

Such valves are generally constructed to be responsive to the circulation of drilling fluid down the conduit or pipe string to close the opening or passage between the pipe string and the annulus, so that all of the drilling fluid is caused to flow to the motor. An example of such a valve is that disclosed in U.S. Pat. No. 3,005,507, granted Oct. 24, 1961, to E. H. Clark, Jr., et al, for Fluid By-Pass For Rotary Drill Bits.

From time to time, it becomes desirable or necessary to circulate drilling fluid with the drill bit off the bottom of the hole, say to flush drilling fluid and cuttings from the hole for a period of time or while rotating the runnng pipe string to release it or prevent it from becoming stuck, or to free a stuck bit. With the usual fill or dump valve, as described above, circulation of drilling fluid without weight on the bit requires that the fluid flow through the motor, causing undesired wear on the motor and bearings, or alternatively that a separate circulation sub be employed in the pipe string. Such a circulation sub is shown, by way of example, in U.S. Pat. No. 3,989,114, granted Nov. 2, 1976, to me and John E. Tschirky, entitled Circulation Sub For In-Hole Hydraulic Motors. The circulation sub of that patent is well suited for its intended purposes, but requires that a blanking plug or mandrel be removably disposed in the shiftable valve member to open the valve and enable the circulation, as well as subsequent retrieval of the mandrel by a wire line tool.

SUMMARY OF THE INVENTION

The present invention relates to in-hole, fluid driven motor apparatus having a valve between the motor housing or stator and the running in pipe string or conduit, the valve being operable, selectively, in response to the flow of fluid through a valve sleeve to open a circulation port which enables the fluid to flow into the annulus, by-passing the motor. These functions are accomplished by a simple and compact assembly, which is operable in response to the commencement and cessation of the pumping of drilling fluid down the pipe string, to assume the various operating conditions described above, without requiring the use of a plug or other device to shift the valve. In its preferred form, the valve sleeve is also operable to automatically open the port as the motor is lowered into the bore hole or retrieved from the bore hole.

More particularly, the present invention involves the provision of a valve structure to be installed between the running in pipe string and motor of in-hole motor drill apparatus, wherein the valve has an outlet normally communicating with the exterior of the valve and closeable in response to the flow of fluid through the valve, upon commencement of the pumping of the drilling fluid, the outlet being selectively re-openable in response to temporary cessation and subsequent resumption of the circulation of fluid, to allow the circulation of fluid upwardly through the annulus, while the motor is at rest.

In accomplishing the foregoing, in a specific sense, the valve has a body, in which a valve sleeve is reciprocable. The body has a side port and the sleeve is normally in a position at which the side port is open to allow the fluid to fill the running in pipe, when the motor apparatus is being lowered through the fluid standing in bore hole. When fluid is circulated down the running in pipe, the valve sleeve is forced to a position closing the side port, so that the fluid flows entirely through the motor. A sleeve control or positioning arrangement of parts is provided which, when circulation is temporarily halted, permits the sleeve to return to a position at which the side port is open, and the sleeve is prevented from reclosing the side port when circulation is resumed.

More specifically, when circulation is resumed the control arrangement is operative to enable the side port to again be closed by the piston, in response to a second temporary cessation and subsequent resumption of circulation of fluid.

Accordingly, a valve is provided which is controlled to allow filling of the pipe string, during lowering, circulation through the motor to drive it, by-pass flow or circulation with the motor idle, and resumed circulation through the motor, in response to the supply of fluid and the cessation of the supply of fluid to the valve, under the control of the operator at the rig at the top of the well. These functions are accomplished without necessity of utilizing any form of auxiliary tool for opening a circulation flow path or the like.

The control arrangement for positioning the valve piston, in response to the interruptions and resumptions of circulation is constructed in the form of a repetitive control cam or slot and follower or pin having stops which limit movement of the valve piston with respect to the side port.

This invention possesses many other advantages and has other purposes which may be made more clearly apparent from a consideration of a form embodying the invention. This form is shown and described in the present specification and in the drawings accompanying and constituting a part thereof. They will now be described in detail, for the purpose of illustrating the general principles of the invention; but it is to be understood that such detailed description is not to be taken in a limiting sense.

BRIEF DESCRIPTION OF THE DRAWINGS

FIG. 4 is a view corresponding with FIG. 2, but showing the valve piston in a position with the side port open, enabling circulation through the annulus with the motor at rest;

FIG. 5 is a planar projection of the control cam slot;

DESCRIPTION OF THE PREFERRED EMBODIMENT

Figure 1:
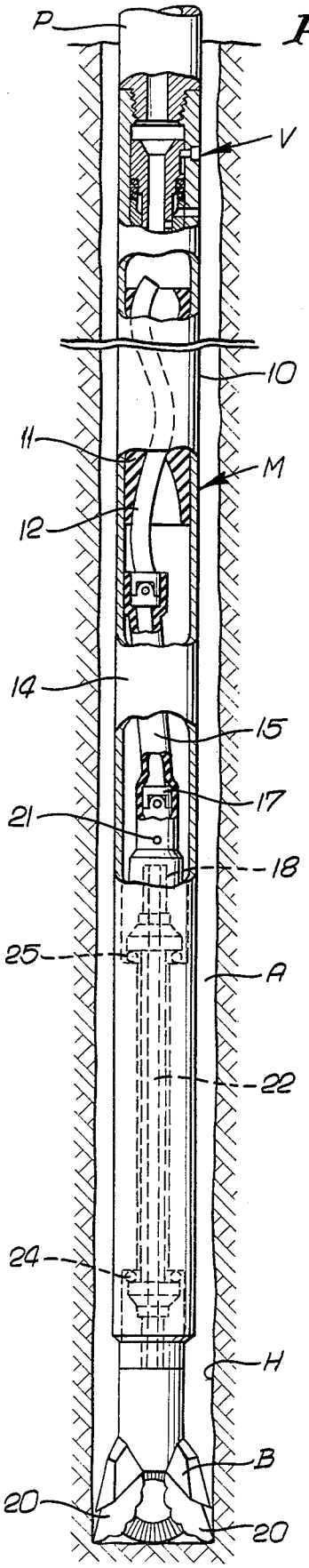
FIG. 1 is a view illustrating fluid driven motor drill apparatus having the valve of the invention incorporated therein, disposed in a bore hole.
Figure 6:
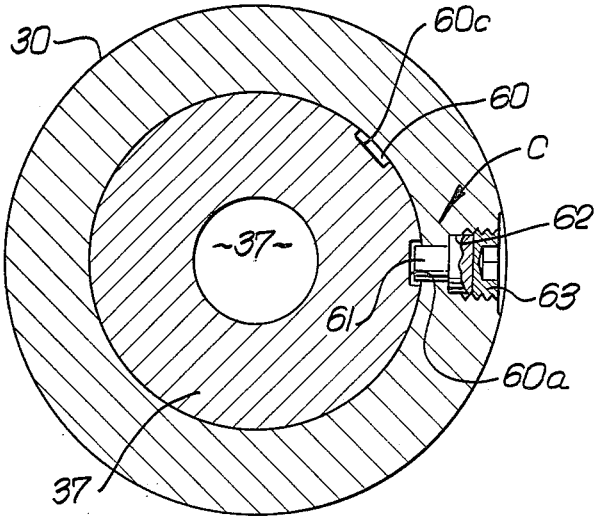
FIG. 6 is a transverse section, as taken along the line 6—6 of FIG. 2.
Figure 7:
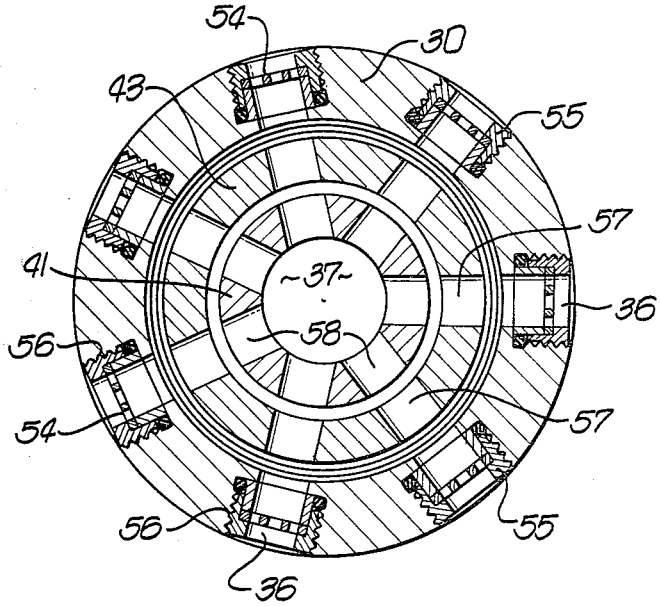
FIG. 7 is a transverse section, as taken on the line 7—7 of FIG. 4.

As seen in the drawings, referring first to FIG. 1, an in-hole motor assembly M is connected to the lower end of a string of drilling fluid conducting drill pipe P and has its housing 10 providing a progressing cavity stator 11 for a rotatable helicoidal rotor 12. The illustrative motor is a positive displacement type fluid motor of a well known kind employed in the drilling of well bores, for example. The rotor is driven by the downward flow of drilling fluid from the pipe string through a valve V, later to be described in detail, the fluid passing downwardly through a connecting rod housing section 14, which contains a connecting rod assembly 15, connected by a universal joint 16 to the lower end of the rotor 12 and by universal joint 17 to the upper end of a drive shaft 18. The drive shaft extends downwardly through a bearing assembly 19, and at its lower end, the drive shaft is connected to a drill bit B, having cutters 20 adapted to drill into or through the earth formation F in the drilling of a bore hole H. The drive shaft is tubular and has adjacent its upper end inlet ports 21, through which the drilling fluid passes from the connecting rod housing 14, into the elongated central bore 22 of the drive shaft, the fluid exiting from the bit B, through the usual orifices, to flush cuttings from the bore hole and to cool the bit. The drilling fluid returns to the top of the bore hole through the annulus A defined between the in-hole apparatus and the bore hole wall.

During operation of the fluid motor M, the lower end of the rotor 12 has an eccentric motion which is transmitted to the drive shaft 18 by the universal connecting rod assembly 15, and the drive shaft 18 revolves about a fixed axis within the outer housing 23 of the bearing assembly 19, the drive shaft being supported within the housing by bearing means generally shown at 24 and 25. The bearing means 24 constitutes a set down bearing through which downward thrust is imposed on the bit B by the housing and the drill pipe of the in-hole apparatus, and the bearing means 25 constitutes a pick up bearing, whereby the pipe string can be elevated to raise or remove the drilling apparatus from the bore hole.

Figure 2:
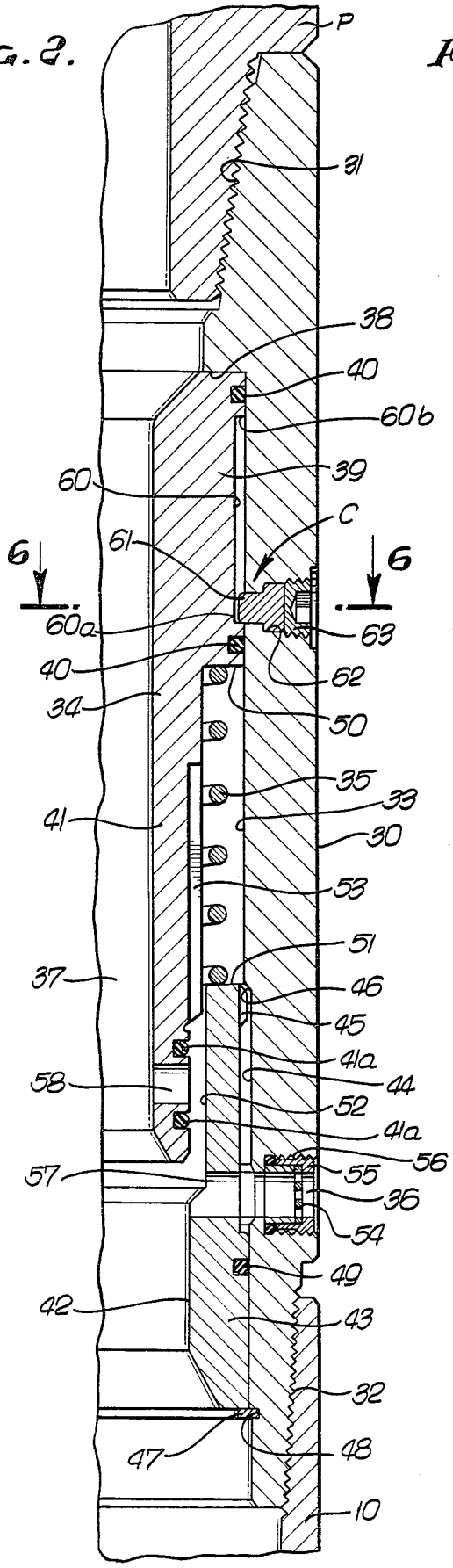
FIG. 2 is an enlarged view, partly in longitudinal section and partly in elevation, showing the valve in a normal condition with the side port open.
Figure 3:
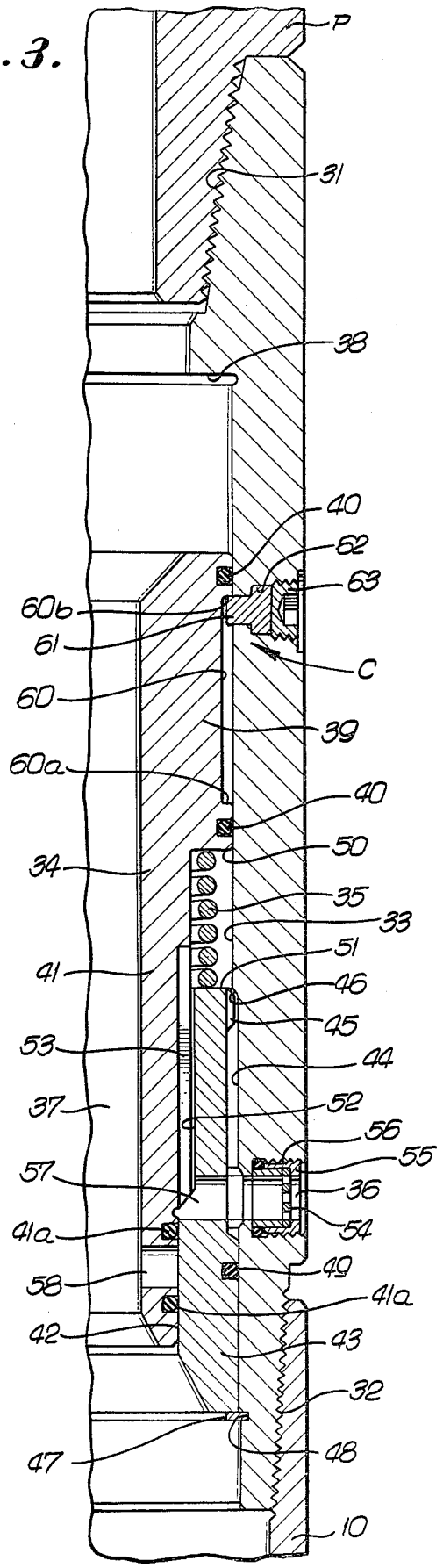
FIG. 3 is a view corresponding with FIG. 2, but showing the valve piston closing the side port, during operation of the fluid driven motor.

Referring to the valve V, seen in detail in FIGS. 2 through 6, it is constructed and operable in such a manner that three flow conditions can be established. In FIG. 2 the valve is in one opened condition, estabishing communication between the pipe string P and annulus A, enabling fluid to enter to fill the pipe or to exit and drain the pipe, as the assembly is lowered into or pulled from the fluid in the bore hole. In FIG. 3, the valve is in an open position preventing the flow to or from the annulus, and causing the flow of all of the motor fluid from the pipe string to the motor, to drive the rotor and turn the bit. In FIG. 4, the valve is in a second open position, enabling circulation of fluid down the pipe string and upwardly through the annulus, while the motor remains idle.

The valve assembly comprises an elongated tubular body 30 having an internally threaded box 31 at its upper end, adapted for threaded engagement with the usual threaded pin on the drill pipe string P. At its lower end, the body 30 has an externally threaded pin 32 adapted for threaded engagement in the upper end of the lower housing 10.

Extending longitudinally within the valve body is a bore 33 adapted to reciprocably receive a valve piston sleeve 34. This piston sleeve 34 is normally biased upwardly by a coiled compression spring 35 to the position of FIG. 2, so that a number of circumferentially spaced side ports 36 are normally open for communication between the annulus A and the interior of the valve body, and fluid can transfer between the annulus and an enlongated fluid passageway 37 which extends through the valve piston sleeve 34. More specifically, the bore 33 of the housing terminates at its upper end at a downwardly facing internal shoulder 38 which forms an upper abutment for the valve piston sleeve 34. On the upper end of the piston sleeve 34 is a piston head 39 having longitudinally spaced side ring or piston ring seals 40 slidably and sealingly engaged within the housing bore 33. Extending downwardly from the piston head 39 is a skirt 41 having adjacent its lower end a pair of circumferentially extended side ring seals 41 adapted to be recieved, as seen in FIG. 3, in a sealing bore 42, adjacent the lower end of the valve assembly, so that the side ports 36 will be closed.

To the extent that the valve, as thus far described, includes a valve piston sleeve which is biased to a position opening the side ports by a spring and shifted by the flow of fluid through the valve sleeve to a position closing the side port, the structure is essentially the same as that disclosed in the above identified U.S. Pat. No. 3,005,507.

The lower sealing bore 42 is provided in a lower, stationery sleeve 43 which is installed in an enlarged diameter bore 44 extending upwardly from the lower end of the housing 30. The lower valve sleeve 43 has, at its upper end, a number of circumferentially spaced lugs 45 which confront a downwardly facing shoulder 46, to limit inward movement of the sleeve 43, and the sleeve is retained in the housing by suitable means, such as a resilient snap ring 47 which is installed in a circumferentially extended groove 48 formed adjacent the lower end of the threaded pin 32. A side ring seal 49 is provided about the lower valve sleeve 43 and is sealingly engaged within the reduced bore 44, below the side ports 36. The spaces between the lugs 45, and the annular space between the valve sleeve 43 and the enlarged bore 44 establish communication between the side ports 36 and the space below the valve piston head 39, to prevent fluid entrapment, and the coiled compression spring 35 is disposed in the space below the piston head 39 in seating engagement with the lower surface 50 of the piston head 39 and the upper surface 51 of the lower valve sleeve 43.

The skirt 41 of the shiftable valve sleeve 34 extends slidably into an upper bore 52 of the lower valve sleeve 43, but the outer periphery of the skirt 41 is provided with a suitable number of circumferentially extended slots 53 which also prevent fluid entrapment in the spring chamber.

As is customary in fill or dump valves, the side ports 36 are provided with screens 54 to prevent the entry of particles of earth formation as fluid is flowing inwardly from the annulus, during lowering of the assembly into the well bore. The screens 54 are in the form of perforated discs mounted in inserts 55 which are threaded, at 56, into threaded bores provided in the valve body at the ports 36.

The lower, stationery valve sleeve 43 has a suitable number of ports 57, spaced circumferentially thereabout and communicating with the body side ports 36, and the shiftable valve sleeve skirt 41 has a suitable number of circumferentially spaced ports 58 between the side ring seals 41*a*. As seen in FIG. 3, when a valve sleeve 34 is shifted downwardly, responsive to the flow of motor fluid through the passage 37, the lower end of the skirt is located below the ports 57 in the lower valve sleeve and the side ports 36 in the body, so that the side ports 36 are effectively closed, and the ports 58 in the skirt 41 of the shiftable valve sleeve 34 are closed within the sealing bore 42 of the lower valve sleeve 43. Under these circumstances, all of the flow of fluid from the pipe string P will be directed through the valve sleeve passage 37 to the fluid motor, so long as the circulation of fluid continues. However, upon cessation of the circulation of fluid, the spring 35 will exert an upward force on the valve sleeve 34 to move the same upwardly.

Control means C are provided which utilize the downward and upward movement of the valve sleeve 34, within the body 30, to cause the valve sleeve to be limited in its downward movement, during circulation of drilling fluid, following cessation or interruption of circulation, as referred to just above, so that the ports 36, 57 and 58, in the body 30 and the two valve sleeves 34 and 43 are in alignment, as seen in FIG. 4, when circulation is resumed. Accordingly, upon resumption of the flow of fluid into the valve assembly, the fluid can by-pass through the aligned ports and can circulate down the pipe string, through the side ports and up the annulus in the well bore. During such circulation the motor can be at rest.

In the specific form herein shown, the control means C comprises a continuous cam track or slot 60 and a cam follower or pin 61. The slot 60 is formed in the outer periphery of the piston head 39, while the pin 61 is carried by the valve body 30, and is in the form of a headed pin disposed in a bore 62 in the body and retained in place by a suitable screw plug 63 threaded in the body.

The cam slot or track 60 is shown in an expanded or planar projection in FIG. 5. The pin 61 is shown, in this view, in each of its for progressive positions designated 61*a*, 61*b*, 61*c* and 61*d*, and the direction of travel of the pin through the continuous slot is shown by the arrows. The slot extends upwardly from a location 60*a*, at the lower left hand corner of the slot configuration, where the pin is located when the piston sleeve 34 is in the uppermost position, as shown in FIG. 2. The slot extends angularly and upwardly and is formed by a cam wall 65 leading to an upper stop position 60*b* which will limit downward movement of the piston sleeve to the position shown in FIG. 3, as the piston sleeve is moved downwardly, in response to the flow of motor fluid therethrough. When such flow is interrupted and spring 35 biases the piston upwardly, the pin will travel from location 61*b* downwardly to inclined cam surface 66 which confronts an oppositely inclined and downwardly extended cam wall 67, to cause the pin to arrive at location 61*c*, at which the valve sleeve 34 is again in the upper position of FIG. 2. Then, when fluid is again circulated through the pipe to the valve assembly, and the valve sleeve 34 again moves downwardly, the pin will move in the slot 60 to engage an upwardly inclined cam wall 68 which leads to stop position 60*d* of the slot, to locate the pin in position 61*d*. Under these circumstances, the downward movement of the valve sleeve 34 is limited to the position shown in FIG. 4, at which the side port 36 of the body is in communication with the lower valve sleeve ports 57 and 58, so that as long as circulation continues, flow can by-pass the motor and flow into the annulus through the open valve. Upon cessation of such circulation, the valve sleeve 34 will again be biased upwardly, and the control pin will move from position 61*d* into engagement with a downwardly and laterally inclined cam wall 69, so as to be moved to the point of beginning at position 61*a*. Thus, it is apparent that the control cam slot is repetitive in nature and that successive interruptions and resumptions of fluid flow from the pipe string to the valve can cause the cycling of the valve sleeve 34 between its three illustrated positions. Such repetitive control devices are well known in the well tool field, and other structures may be utilized. For example, while the structure herein illustrated is one which requires that the valve sleeve 34 be angularly shifted as it moves between its three positions, it is also known that the control pin or follower may be carried by a rotatable ring, so that the motion of the valve sleeve 34 could be purely linear.

From the foregoing, it will now be apparent that the present invention provides a novel and improved structure whereby fluid directed to an in-hole motor from a source at the top of a well bore can be utilized to establish selected positioning of a valve member, whereby the fluid can be directed solely to the motor or can be directed in a path from the pipe string to the annulus, by-passing the motor, or fluid can be allowed to flow into and from the pipe during the running and retrieving of the motor assembly.

The sequence of operative steps are as follows:

1. When running into the well, the valve is in the condition of FIG. 2, with control pin 61 at location 60*a*, and fluid can enter the pipe string.

2. Circulation of fluid is commenced, and flow through the valve moves the valve to the closed position of FIG. 3, compressing the spring. The control pin is then at location 60*b*, and all fluid flows to the motor.

3. Circulation can be interrupted, and the spring will return the valve to its upper position, placing the pin in location 60*c*; if the pipe is pulled upwardly, the pipe will drain through the open valve.

4. On resumption of circulation through the valve, it is moved to the position of FIG. 4, and the pin is at location 60*d*, limiting downward movement of the valve to keep the side port open for by-passing the motor.

5. Another interruption of circulation allows the spring to return the valve to the position of FIG. 2 and the pin will again be at location 60*a*.

The angular relationship between the ports and the cam slot is such that the ports are radially aligned when in the open condition.

I claim:

1. An in-hole motor apparatus comprising: an in-hole fluid driven motor having housing structure connectable to a pipe string for receiving motor driving fluid and a valve assembly; said valve assembly including a tubular body member having a side port; said side port communicating with the interior and exterior of said body member and said housing; a valve sleeve member having a flow passage longitudinally therethrough for the flow of fluid to said motor when communication between said side port and said exterior is closed; said valve sleeve being shiftable in said body member in response to fluid flow and interruptions of fluid flow between a first, second and third positions at which said side port is in sequence opened, closed and reopened, and control means for positioning said sleeve member in said first, second and third positions in said sequence.

2. An apparatus as defined in claim 1; said control means comprising a cam track in one of said members and a cam follower in the other of said members.

3. Apparatus as defined in claim 1; said control means comprising a continuous cam track on said valve sleeve and a cam follower carried by said body and engaged with said track.

4. Apparatus as defined in claim 1; said sleeve having a by-pass port therein; a sealing bore in said body receiving said by-pass port when said sleeve in said in second position; said by-pass port and said side port communicating when said sleeve in in said third position.

5. Apparatus as defined in claim 1; said sleeve having a by-pass port therein; said control means permitting movement of said sleeve to said first portion, movement of said sleeve in said second position and limiting movement of said sleeve to said third position at which said by-pass port and said side port communicate.

6. The method of controlling the circulation of fluid to an in-hole motor drill through a pipe to the motor or from a by-pass valve port in the pipe to the annulus, comprising closing the by-pass valve port by circulating fluid through the valve to the motor, interrupting the circulation of fluid, to said motor and thereby closing said by-pass port, then resuming the circulation of fluid through said valve to open the by-pass valve port for circulation through the by-pass valve port to the annulus, with the motor idle.

7. The method of claim 6, including again interrupting circulation of fluid and then resuming circulation to close the by-pass and circulate fluid through the valve to the motor.

* * * * *